US005477300A

United States Patent [19]

Fujimoto et al.

[11] Patent Number: 5,477,300

[45] Date of Patent: Dec. 19, 1995

[54] METHOD FOR PROCESSING PHOTOGRAPHIC LIGHT-SENSITIVE MATERIAL

[75] Inventors: Hiroshi Fujimoto; Hideaki Nomura; Akira Abe, all of Kanagawa, Japan

[73] Assignee: Fuji Photo Film Co., Ltd., Kanagawa, Japan

[21] Appl. No.: 180,390

[22] Filed: Jan. 12, 1994

[30] Foreign Application Priority Data

Jan. 13, 1993 [JP] Japan ..... 5-019443

[51] Int. Cl.[6] ..... G03D 13/00; G03D 3/08

[52] U.S. Cl. ..... 354/298; 354/322; 354/324; 354/320

[58] Field of Search ..... 354/298, 299, 354/319–324, 334; 430/30, 398–400; 134/64 P, 64 R, 122 P, 122 R

[56] References Cited

U.S. PATENT DOCUMENTS

| | | | |
|---|---|---|---|
| 3,696,728 | 10/1972 | Hope | 354/298 |
| 3,699,869 | 10/1972 | Jensen | 354/321 |
| 3,785,269 | 1/1974 | Morioka | 354/322 |
| 4,402,590 | 9/1983 | Rubin | 354/324 |
| 4,466,072 | 8/1984 | Kaufmann | 354/298 X |
| 4,572,639 | 2/1986 | Mackson | 354/322 |
| 4,603,956 | 8/1986 | Baker | 354/298 |
| 4,872,033 | 10/1989 | Watanabe et al. | 354/322 X |
| 4,907,023 | 3/1990 | Koboshi et al. | 354/321 |
| 5,001,506 | 3/1991 | Nakamura | 354/324 |
| 5,146,257 | 9/1992 | Lemberger et al. | 354/324 X |
| 5,179,406 | 1/1993 | Nakamura | 354/324 |
| 5,327,189 | 7/1994 | Wernicke | 354/319 |

*Primary Examiner*—D. Rutledge

*Attorney, Agent, or Firm*—Sughrue, Mion, Zinn, Macpeak & Seas

[57] ABSTRACT

A photographic light-sensitive material processing method in which not only a low-replenishment process, a speedy process and a compensation process in addition to a standard process can be carried out, but replenishment can be performed appropriately for various types of film or the like. A plurality of color developers are accommodated in respective developing tanks. A controller sets conveyance paths to selectively convey light-sensitive materials to any one of the development tanks. Further, the controller controls the operations of replenishment pumps by calculating the appropriate replenishment rate in accordance with the quantity of processing of film through a conveyance quantity detection sensor, a density detection sensor, a memory and an arithmetic operation unit.

20 Claims, 6 Drawing Sheets

METHOD FOR PROCESSING PHOTOGRAPHIC LIGHT-SENSITIVE MATERIAL

BACKGROUND OF THE INVENTION

The present invention relates to a developing method for silver-halide color photographic light-sensitive materials (photographic films or the like), and particularly relates to a light-sensitive material processing method in which a plurality of color photographic light-sensitive materials of different photographic characteristics can be processed by one processing apparatus.

In processing of silver halide photographic light-sensitive materials, a developing agent in a developer is consumed by developing silver halide photographic light-sensitive materials, for example, in the developing treatment, or is tired by oxidation with the passage of time, while, at the same time, halogen ions are accumulated, so that the processing capacity is lowered. Measures are therefore generally taken to supply replenisher to maintain processing capacity.

When the replenisher are supplied to respective solutions so that the processing capacity is strengthened, however, overflow solutions are discharged in quantities nearly the same as the replenishment rates, becoming merely wastes. Reduction of wastes is therefore required.

With the advance of developing techniques, distributed photographic processing has progressed so that photographic processing is now often performed in mini-scale or micro-scale laboratories as well as in the more conventional large-scale laboratories. In mini-scale or micro-scale laboratories, difficulties in waste disposal often occur because of the unavailability, due to high costs and space considerations, of a plant for waste disposal using activated sludge, etc., and the difficulty of collecting wastes.

There is therefore a demand for a waste reducing technique as a substitute for waste disposal.

On the other hand, in specific fields of utilization, it is required to develop light-sensitive materials speedily after photographing. For example, in the cases of news photographs, photographs on a construction site, photographs for results in sports competitions or the like, as well as sightseeing photographs, it is often required that photographing results be made available rapidly by speedily processing such photographs just after photographing.

Further, certain compensation may be required in developing a light-sensitive material after photographing in accordance with specific photographing conditions, the photographer's wishes, etc. For example, a light-sensitive material subjected to photographing in a high-contrast condition where it is exposed to the direct rays of the sun and a light-sensitive material subjected to photographing in a low-contrast contrast condition such as a cloudy weather condition are very different in terms of quantity of exposure. It is therefore preferable that a soft-tone light-sensitive material be used for high-contrast photographing conditions and a hard-tone light-sensitive material be used for low-contrast photographing conditions in order to obtain images uniform in results. Further, even in the case where identical light-sensitive materials are used for the aforementioned two conditions, there may be requested compensation so that, for example, images uniform in results are obtained by carrying out a softening or hardening process at the time of development.

Further, there are many cases where neither a compensation process nor speedy processing is specifically required, but only a standard process is carried out. Accordingly, it is required that the standard process be carried out in the above-mentioned mini-scale laboratories of photographic shops and the like.

It is, however, not advisable to provide processing apparatuses having the above-mentioned processing functions individually due to the high costs and large amount of installation space required. Further, if the number of treating tanks is increased simply to provide multiple functions in one processing apparatus, the size of the apparatus is increased.

An apparatus has been disclosed in U.S. Pat. No. 3,699,869 which is adapted to process two types of light-sensitive materials different in sensitivity. The apparatus is, however, insufficient in the case where processes different in function, for example, a standard process and a speedy process, or a standard process and a low replenishment process, are to be carried out. That is, in the case where two kinds of processes different in function as described above are carried out in one processing apparatus, a replenishing system for one process cannot be used as a replenishing system for the other process directly. Accordingly, it is not easy to replenish processing solutions, so that it is difficult to obtain equal-quality images by the different processes.

SUMMARY OF THE INVENTION

An object of the present invention, therefore, is to solve the aforementioned problems, that is, to provide a photographic light-sensitive material processing apparatus in which not only a speedy process, a low replenishing process and a compensation process (such as a softening process, a hardening process, etc.) can be carried out, but preferable images can be formed by supplying replenishers appropriately.

The foregoing and other objects of the present invention have been attained by a photographic light-sensitive material processing apparatus comprising:

means for supplying said sensitive material;

a plurality of development tanks for developing latent images on said sensitive material, in which a plurality of different color developers are accommodated, respectively;

control means for determining one of said development tanks corresponding to characteristics of the processing for said sensitive material thus supplied; and a group of tanks for subjecting said sensitive material thus developed to processing of a series of breaching, fixing, washing and stabilization.

The above apparatus further includes a means for detecting said characteristics of the processing for each sensitive material.

The control means calculates replenishment rate for each of the developers of said plurality of development tanks.

The replenishment rates may be calculated on the basis of the number of exposed images, or on the basis of accumulated values of image densities of the light-sensitive materials after processing.

The replenishment is carried out after processing a predetermined quantity of light-sensitive materials to supply the necessary replenishment rate in batches.

In the case where light-sensitive materials are to be processed by the above-mentioned processing, a plurality of same-type light-sensitive materials may be processed with a plurality of developers differing in photographic characteristics, or a plurality of light-sensitive materials of different. types may be processed with a plurality of developers differing in photographic characteristics.

The term "light-sensitive materials of different types" means Light-sensitive materials which differ in photographic characteristics when the light-sensitive materials exposed under an appropriate condition are subjected to development under the same conditions. Examples of these photographic characteristics include sensitivity (ISO), maximum density ($D_{max}$), gradation (G), etc. For example, with respect to sensitivity, elements differing by 1.5 or more in sensitivity rate can be shown as substantially different elements.

The term "plurality of developers of different photographic characteristics" means developers which differ in photographic characteristics such as sensitivity, $D_{max}$, gradation, etc., even in the case where light-sensitive materials of the same are subjected to development because of differences in the kind or content of developing agents, preservatives, halogens, pH buffers, organic anti-fogging agents, and so on, in the developers, or differences in characteristics such as the pH of the developers.

A typical example is a rapid processing developer in which the developing activity is improved by increasing the concentration of a developer or the concentration of a pH buffer, a low replenisher having high-activity and high-suppression which contains $2\times10^{-2}$ mol/l or more of bromide ions and in which the concentration of a developing agent or pH buffer is increased, and a low-activity fine-grain developer in which the concentration of a low-activity developing agent or the concentration of an anti-fogging agent is increased.

Preferably, two or three development tanks are used, more preferably, two tanks are used.

According to the present invention, a plurality of light-sensitive materials differing in characteristics can be treated with a plurality of color developers also differing in characteristics.

Examples of combinations of developing processes include: a standard-time developing process and a rapid developing process, a standard-replenishment developing process and a low-replenishment developing process, a long-time low-temperature high-quality process and a rapid high-temperature process, a standard-gradation developing process and a hard-gradation developing process, a standard-gradation developing process and a soft-gradation developing process, etc. These processes can be carried out according to the present invention.

In a rapid process in which the processing time is shortened to two-thirds or less compared with the standard processing time, there are required an increase of the pH of a color developer, an increase of the concentration of a color developing agent, an increase of processing temperature, an adjustment of the concentration of an anti-fogging agent such as bromide ions, the use of different-type color developing agents, etc. There are many cases where the light-sensitive materials used must be designed so that excellent photographic characteristics are obtained under the aforementioned conditions. For example, in order to make the progress of development of a lower layer in an emulsion film rapid, it is necessary to thin a coating layer, introduce two equalizing couplers, use emulsions differing in halogen composition, etc., for the standard-processing light-sensitive material.

As an example, in a case of use of two kinds of sensitive materials including one standard-time developing sensitive material and another rapid developing sensitive material, the two sensitive materials may be subjected to development processing in the apparatus having a standard-time development tank and a rapid development tank.

Further, when the replenishment rate in the standard-replenishment process is reduced to two-thirds or less compared with the standard replenishment rate because of an increase of the concentration of bromide ions or various anti-fogging agents eluted from the light-sensitive materials being processed, it becomes difficult to obtain optimum photographic characteristics in standard-processing light-sensitive materials. There is thus required an increase of the pH of the color developer, an increase of the concentration of the color developing agent, an increase of the processing temperature, introduction of different color developing agents, etc. It is necessary that the light-sensitive materials be designed to fulfill optimum sensitivity and optimum gradation under the aforementioned color developing conditions.

In the aforementioned combination processes, necessary processes are automatically determined in accordance with the type of light-sensitive material, so that the light-sensitive material is not treated with both color developers in both development tanks. Namely, the corresponding relationships between any kinds of sensitive materials and development processing are predetermined, respectively. Accordingly the actual one development processing is determined so that the light-sensitive material is not treated with both color developers. In the present invention, however, development tanks may be arranged so that a developer overflows from one development tank to the other development tank as occasion demands.

Further, as for other processes after the developing process, any kind or any combination of processes may be used.

In the present invention, the replenishment rates are calculated on the basis of a constant or function determined on the basis of the quantity of processing of the light-sensitive materials in advance. The replenishment rates are calculated on the basis of a preliminarily set constant or function individually for developers in the respective development tanks.

In this case, the sensor for detecting the quantity of processing of light-sensitive materials is common to a plurality of light-sensitive materials, so that the quantity of processing of a plurality of light-sensitive materials is detected by one sensor.

The "number of exposure images" means the number of images (the number of scenes) exposed at regular intervals. In the case of a light-sensitive material for photographing, it means the number of photographed frames. To detect the number of exposure images, a method of detecting the respective frames of images or detecting identification information (for example, in the form of notches or magnetic information) applied to each unit image to thereby count the number thereof, or another known method can be used.

To detect the image density, measurement is performed by a density sensor after development. In this measurement, the average optical density of the whole of an image may be measured in every unit image, or the optical density of a representative area of a unit image may be measured, or a part may be measured continuously in the conveyance direction. Any known method can be used.

In the case of a photographic color film in which the support of the light-sensitive material is light-transmissible and slightly colored, the optical density obtained as a result of measurement of the light-sensitive material after development contains density (mask density) based on dyes or the like. In the present invention, the replenishment rates are calculated on the basis of the accumulated value of the optical density of the light-sensitive material after development, but the mask density of the light-sensitive material varies in accordance with the kind of the light-sensitive material. Accordingly, it is preferable that compensation be effected by subtracting the mask density from the optical density for calculation of the quantities of a developing agent and the like consumed by development. Because the mask density of the light-sensitive material varies in accordance with the kind of the light-sensitive material, variations in mask density in accordance with the kind of the light-sensitive material and as a function of compensation for optical density based on the mask density are stored in a storage device in advance so that the mask density and the function are read and used for calculation of the replenishment rates whenever a light-sensitive material is processed.

In this manner, the quantities of consumption of the developing agent and the like are calculated on the basis of the optical density of the light-sensitive material read by a densitometer or the like after development, appropriately considering the mask density of the light-sensitive material, by which the replenishment rates required for recovering performance can be calculated accurately so that the performance of the developers can be kept constant.

A photographic light-sensitive material will be described below by way of example. The performance of a developer is lowered because of processing of the light-sensitive material and air oxidation. Therefore, a replenisher is appropriately supplied in order to remedy the lowered performance. The replenisher is supplied on the basis of the quantity of processing of the light-sensitive material. In the present invention, detection of the number of photographed frames (the number of exposure images), as described in Japanese Patent Unexamined Publication No. Hei-4-140744, is preferably used for the detection of the quantity of processing.

It may be difficult to perform appropriate replenishment if the quantity of processing is detected just on the basis of the quantity of feeding of the light-sensitive material in a manner used generally. When, for example, a large quantity of non-exposed portions remains in the light-sensitive material, the fatigue of the developer caused by the processing of the light-sensitive material is small so that the quantities of main components and the like become excessive if the replenishment is supplied just in accordance with the quantity of feeding of the light-sensitive material. As a result, it is difficult to obtain the desired performance. Particularly in replenishing a low-replenish developer, the influence of the replenisher on the tank solution is large, so that accurate replenishment is required. To improve the replenishment accuracy, therefore, it is preferable to detect the quantity of development of exposed portions. Accordingly, the number of all frames after development or the accumulated value of density is calculated and the replenishment rate is calculated on the basis of this value.

Further, with respect to photographed frames, the average exposure quantity of one frame varies in accordance with the photographing conditions, such as whether photographing was performed under high lighting conditions, such as on a skiing ground or at a beach, or under low lighting conditions, such as indoors. Specifically, under the former photographing conditions, the quantity of exposure is generally large so that the quantity of consumption of the developing agent becomes large, but in the latter photographing condition, the quantity of exposure is small so that the quantity of consumption of the developing agent becomes small. If a constant quantity of the o replenisher were supplied without consideration of the above-mentioned facts, the performance of the developer would change, to make it difficult to obtain the desired performance. Accordingly, it is preferable that the number of frames be measured after processing, or the image density be measured by the density sensor so that replenishment is performed whenever the number of frames or the accumulated value of density reaches a predetermined value.

With respect to the timing of supplying the replenisher, replenishment may be performed in the developing process or after the developing process. As occasion demands, replenishment may be performed at the time of adjustment of temperature or the like before the actual developing process.

Further, in a replenishing pump generally used in a photograph processing apparatus, error decreases as the replenishment increases. Accordingly, the replenishment accuracy can be improved by increasing the intermittent time of replenishing a low-replenishment developer and by performing replenishment collectively after processing a large number of light-sensitive materials. It is however, necessary that the collective replenishing rate be sufficiently small compared with the volume of the processing solution in the tank. This is because the variation in composition of the color developer is revealed between before and after the replenishing process so as to exert an influence on the photographic quality. In the present invention, preferably the replenishing rate of one time is not larger than 7% of the quantity of the solution in the tank, more preferably not larger than 5% of the quantity of the solution in the tank.

Alternately, replenishment includes not only the above solution replenishment in accordance with the quantity of processing so as to cover fatigued components, but also water replenishment so as to cover a quantity of water vaporized from the processing solutions. The replenishment of water reduced by vaporization is preferably performed individually. Because the quantity of vaporization of water is affected by the temperature of the processing solutions, ambient temperature, humidity, etc., the replenishment rate of water is calculated on the basis of these values. By such replenishment of water, stability in composition of the developer is improved so that photograph characteristics having high quality are obtained.

Processing information or replenishment information may be added to the light-sensitive material used in the present invention by various methods. For example, information can be carried on the light-sensitive material itself, a package such as a film patrone, a film cartridge, etc., a leader, or the like, by magnetic recording means (transparent magnetic layer, stripe-shaped magnetic layer, etc.) or optical recording means (bar code, etc.). Alternatively, information can be carried on such a package by a CAS code (using electrically conductive o portions, concave-convex portions or the like), electric recording means (semiconductor element, etc.), physical means (means of forming a part of the Patrone or cartridge into a special shape, etc.), or the like. Details of such techniques are described in Japanese Utility Model Unexamined Publications Nos. Hei-3-69145 and Hei-3-69146 and International Publication WO90/04205 (Japanese Patent Unexamined Publication No. Hei-4-502518). These techniques can be employed in the present invention.

Further, the information is read in accordance with the recording method by information reading means provided in the developing apparatus, or an apparatus connected thereto, so that the information is used for determining the processing conditions. A known technique can be used as the information reading means. The "information carried"

means information for selecting and designating the light-sensitive material processing conditions. An example of the information is information for designating processes, processing tanks to be used (such as development tanks, etc.), conveyance paths, and the like, for the light-sensitive material. The information is predetermined in accordance with the kind of the light-sensitive material, namely the information does not include information obtained at the time of using the light-sensitive material (at the time of taking photograph) such as lighting conditions, exposure time, etc.

Typical examples of the light-sensitive material used in the present invention include photographic light-sensitive materials (such as a color negative film, a color reversal film, etc.). It is to be understood that the light-sensitive material is not limited thereto and that another silver halide photographic light-sensitive material can be used.

DESCRIPTION OF THE PREFERRED EMBODIMENTS

Preferred embodiments of the present invention will be described with reference to the accompanying drawings.

Figure 1:
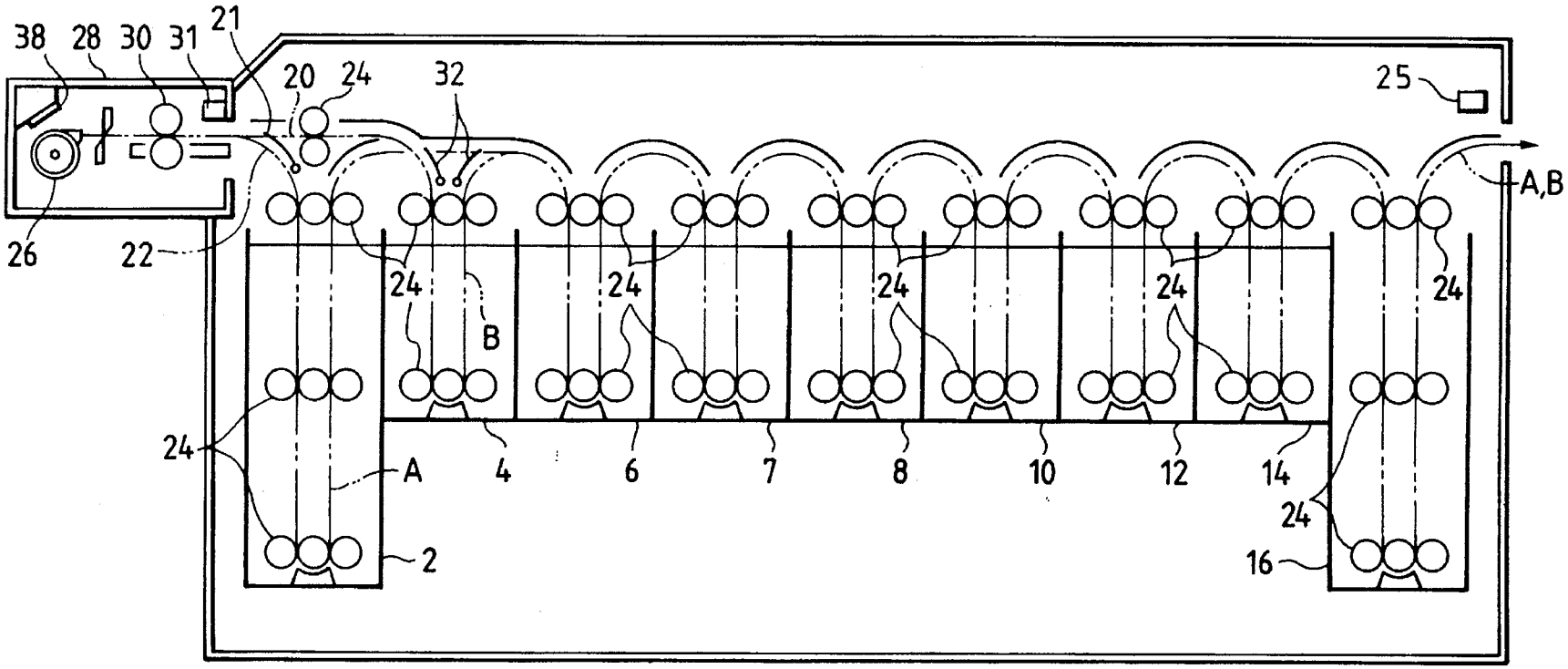
FIG. 1 is a structural view of a light-sensitive material processing apparatus constructed in accordance with a preferred embodiment of the present invention.

FIG. 1 is a structural view of a light-sensitive material processing apparatus operating in accordance with the present invention. This apparatus is provided to process two different types of color negative films A and B with two kinds of developers appropriate to the respective films. In this embodiment, the apparatus can process a standard processing color negative film A used generally for photographing and a low replenishment and rapid processing color negative film B having characteristics of the replenishment rate of developer lower than and developing speed early than the standard development process. In the processing apparatus, a first color development tank 2, a second color development tank 4, a bleaching tank 6, a bleaching-fixing tank 7, a fixing tank 8, a first washing tank 10, a second washing tank 12, a stabilization tank 14 and a drying portion 16 are arranged in the stated order.

A standard developer for standard processing is accommodated in the first color development tank 2, and a low replenishment and rapid developer lower in the required replenishment rate and shorter in processing time than the standard developer is accommodated in the second color development tank 4. A bleaching solution is accommodated in the bleaching tank 6, a fixing solution is accommodated in the fixing tank 8, washing water is accommodated in the first and second washing tanks 10 and 12, and a stabilizing solution is accommodated in the stabilization tank 14. The washing tanks 10 and 12 are arranged in a counterflow cascade state so that washing water is supplemented to the downstream-side second washing tank 12 and overflow water from the second washing tank 12 is supplied to the first washing tank 10. The drying portion 16 dries the swollen films A and B by blowing hot air against the films A and B.

Two introduction paths 20 and 22 are provided separately in an inlet of a processing portion, so that the films A and B introduced through the introduction paths are successively conveyed to respective processing tanks by conveyance rollers 24 and immersed in respective processing solutions for respective predetermined periods thereby to be processed.

Each of the exposed films A and B is loaded in a film charging portion 28 while accommodated in a cartridge 26, and then drawn out of the cartridge 26 and conveyed to the processing portion. The film charging portion 28 is common to the films A and B regardless of the film type, so that the conveyance paths of the films A and B are switched and selected by a movable guide member 21 provided in the inlet of the processing portion. Preferably, the selecting operation of the paths for the films A and B is performed automatically. That is, the determination of which respective paths for the films A and B is selected is performed automatically in accordance with the information previously provided in the film thus conveyed, so that the operator of the apparatus need not decide. The information may be provided in the films via bar codes, via the shape of the cartridge, or read from the front end of the film drawn from the cartridge. A sensor 31 for detecting the quantity of conveyance of film is provided in the proximity of a conveyance roller pair 30 as required. This sensor 31 may be, for example, of the type that detects the quantity of rotation of the conveyance roller pair or the quantity of movement of film A or B, by which the quantity of processing of film is detected to calculate the required replenishment rate, as will be described later. The respective introduction paths 20 and 22 are provided to guide the films A and B respectively to either of the two development tanks 2 and 4. By guiding the films A and B while selecting one of the introduction paths 20 and 22, either of the development tanks 2 and 4 is selected so that the films A and B are respectively treated with either of the developers.

As a substitute for the sensor 31, a density detection sensor 25 (described later) may be preferably used for detecting the number of exposed images or optical density to thereby detect the quantity of processing of film.

Figure 2A:
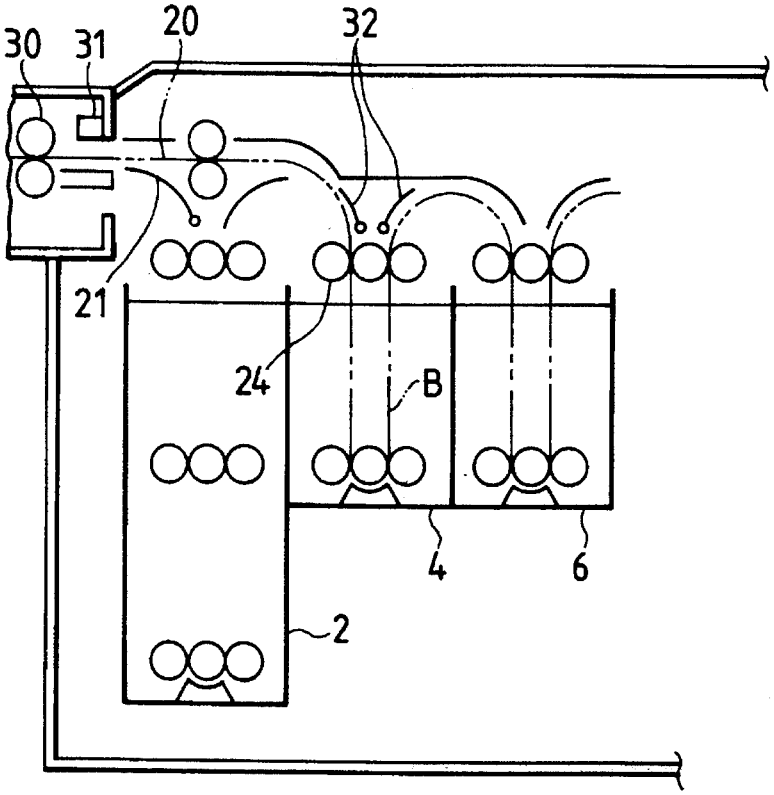
FIGS. 2(A) and 2(B) are enlarged views of the vicinity of the light-sensitive material carrying-in portion depicted in FIG. 1.
Figure 2B:
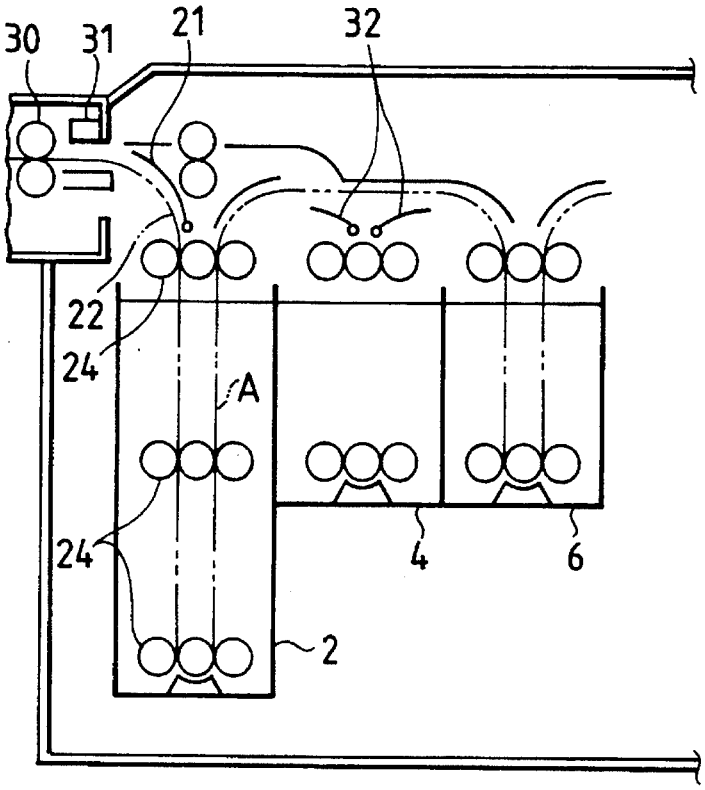

Further, as shown in FIG. 2, one of the introduction paths 20 and 22 is selected in the inlet of the processing portion by a movable guide member 21 and, at the same time, the conveyance paths of the films A and B are selected by appropriately operating a movable guide member 32 disposed above the second color development tank 4.

When the first introduction path 20 is selected, the movable guide member 32 rotates to a position to guide the film B substantially in the vertical direction, as shown in FIG. 2(A), so that the film B is guided to the second color development tank 4 through the first introduction path 20. When the second introduction path 22 is selected, the movable member 32 rotates to a position to guide the film A substantially in the horizontal direction as shown in the diagram (B) in FIG. 2 so that the film A treated in the first color development tank 2 is guided to the bleaching tank 6 while skipping the second color development tank 4.

Processes after the bleaching tank 6 are common to all films A and B, so that the films A and B subjected to color development with a developer in either of the first and second color development tanks 2 and 4 are successively subjected to the bleaching process, the bleach-fixing process, the fixing process, the washing process and the stabilization process and then dried.

Replenishing devices (not shown) constituted by pumps and the like for supplying replenishers are provided in each of the first color development tank 2, the second color development tank 4, the bleaching tank 6, the bleach-fixing tank 7, the fixing tank 8, the washing tanks 10 and 12 and the stabilization tank 14. A sensor 25 for detecting the density of the films A and B after drying, or detecting the number of frames, is provided in the drying portion 16 as occasion demands.

As shown in FIG. 1, the first development tank 2 is deeper than the second development tank 4, so that the quantity of first developer accommodated by the first development tank is larger than the quantity of second developer accommodated by the second development tank. The rotational speed of the conveyance rollers 24 may be changed in accordance with the two types of processes, but it is structurally easy to set the rotational speed to be constant. Accordingly, a speedy developer capable of performing development in a short time can be accommodated in the second development tank 4 in which the time of conveyance in the developer is short. For instance, there may be used a standard developer as the first developer and a speedy developer or a low-replenishment developer as the second developer. Accordingly, when, for example, a standard developer and a speedy developer are accommodated in the first and second development tanks 2 and 4, respectively, standard development and speedy development can be selected.

In the following, the film charging portion 28 will be described.

Figure 3:
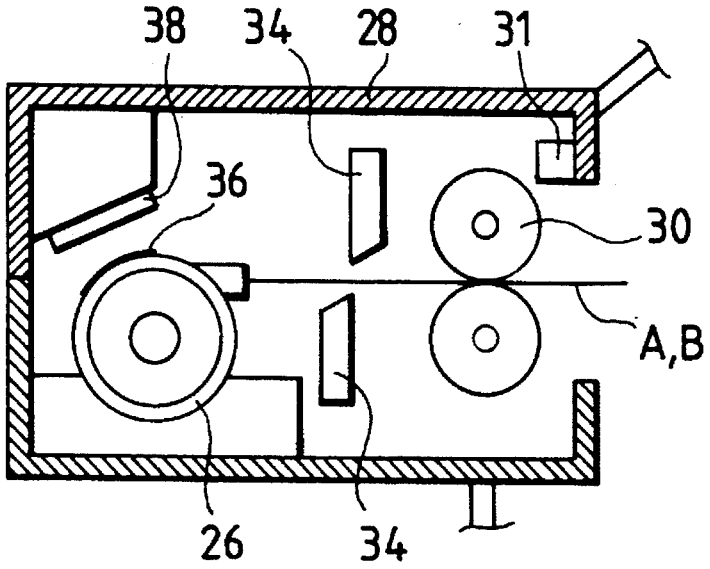
FIG. 3 is a sectional view of a light-sensitive material charging portion.
Figure 4:
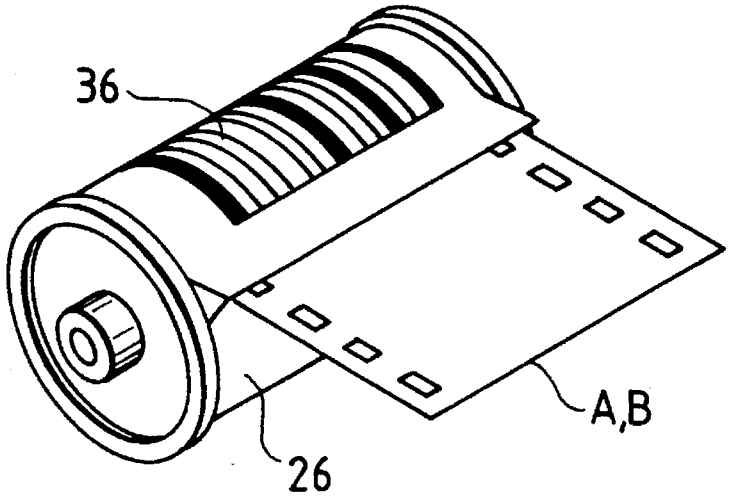
FIG. 4 is a perspective view of a cartridge provided with a bar code.

FIG. 3 is a sectional view of the film charging portion 28. The film A or B can be drawn out by rotating the conveyance roller pair 30 while nipping the leading portion of the film A or B out of the cartridge 26 between the conveyance roller pair 30 after charging the cartridge 26 in the film charging portion 28. The film A or B, upon being drawn out entirely, is cut off by a cutter 34 so that the film is separated from the cartridge 26. As shown in FIG. 4, a bar code 36 as an information carrier is provided on the outer surface of the cartridge 26, so that the cartridge carries information concerning the film A or B, indicating information such as film type, sensitivity, development method, number of frames, etc. A light-reflection type bar code reading sensor 38 is provided inside the charging portion 28 and opposite the bar code 36 at the time of charging the cartridge in the charging portion 28, so that the bar code 36 on the charged cartridge 26 can be read.

Because the charging portion 28 is of course shielded from light, it serves as a dark room. It is, however, necessary that the bar code reading sensor 38 emit light at the time of reading the bar code 36. The operation of the bar code reading sensor 38 is controlled so that the bar code reading sensor 38 emits light to read the bar code 36 before the drawing of the film A or B out of the cartridge 26 to thereby prevent the photographed portion of the film A or B from being exposed to light. Further, the operation of the bar code reading sensor 38 is controlled so that film conveyance is not performed unless the bar code 36 is read, and that the bar code reading sensor 38 does not operate when a film driving system operates to draw out the film. There is little or no risk of film exposure in the case where the bar code reading sensor 38 is of a type using safety light. It is however preferable that light emission in this case still be controlled in the same manner as described above.

As a substitute for the bar code 36, an electrically conductive portion or a concave-convex portion as a CAS code may be provided on the cartridge 26, or a magnetically recorded portion-may be provided. In these cases, the light-reflection type bar code reading sensor 38 is replaced by a bar code reading sensor employed in accordance with the chosen information carrying method. The position wherein information such as a bar code 36 is applied is not limited to the position shown in the drawing. Any position may be used if the position is on the outer surface of the cartridge 26. For example, the forward end portion of the film A or B pulled out of the cartridge 26 or the leader portion connected to the film A or B may be selected.

The information concerning the film A or B, read by the bar code reading sensor 38, is supplied to a controller 40 (described later), so that the information is used for control of the driving system, control of supplying of the replenisher, etc.

Figure 5:
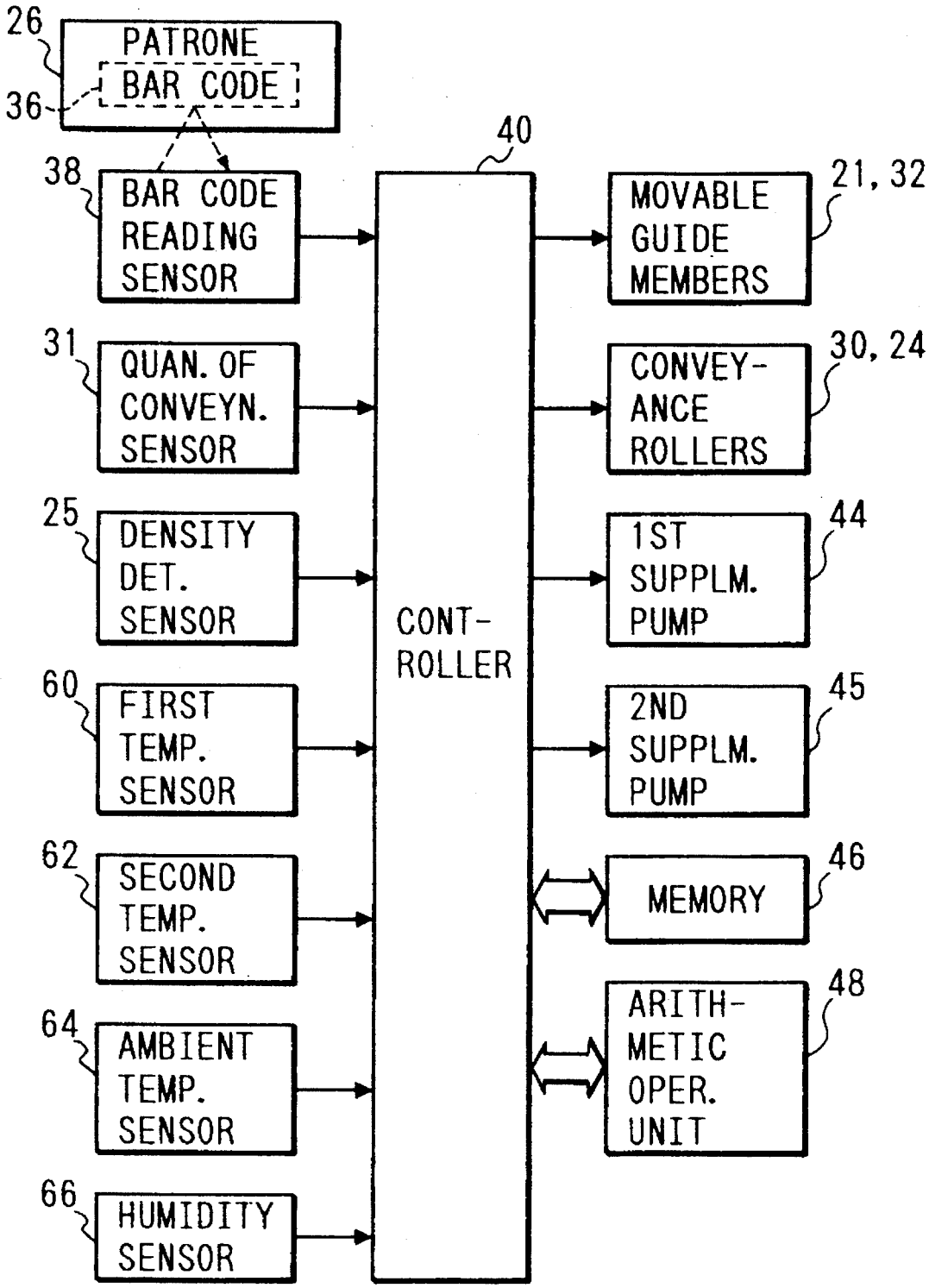
FIG. 5 ms a structural view of conveyance control and supplement control performed by a controller.

FIG. 5 is a block diagram of a structure in which conveyance path switching control and replenishment control are carried out by the controller 40.

The bar code bar code reading sensor 38, the conveyance quantity detection sensor 31, and the exposure image number detection sensor or density detection sensor 25 are connected to the input side of the controller 40 so that information of the film A or B detected by the sensors 38, 31 and 25 is supplied to the controller 40. Further, two liquid temperature sensors 60 and 62 for detecting the respective temperatures of the first and second development solutions, an ambient temperature sensor 64 for detecting the ambient temperature in the processing apparatus, and a humidity sensor 66 for detecting humidity are connected to the input side of the controller 40. The bar code reading sensor 38, the conveyance quantity detection sensor 31 and the density detection sensor 25 are used when functions lowered by processing of the film A or B are to be recovered by supplying of the replenisher. The liquid temperature sensors 60 and 62, the ambient temperature sensor 64, and the humidity sensor 66 are used when water vaporized from the treating solution is to be replenished (vaporization replenishment). This vaporization replenishment will be described later.

The guide members 21 and 32, the conveyance rollers 30 and 24, and the first and second replenishing pumps 44 and 45 are connected to the output side of the controller 40. The replenishing pumps 44 and 45 are arranged so as to supply the replenishers to the first and second development tanks 2 and 4, respectively. Further, a memory 45 and an arithmetic operation unit 48 are connected to the controller 40, so that information obtained from the bar code reading sensor 38 and information stored in the memory 46 are compared and collated with each other by the arithmetic operation unit 48 to thereby judge the kind of the film A or B, the processing method, the replenishing mode, etc. The operations of the guide members 21 and 32 are controlled by the controller 40 to switch the conveyance paths on the basis of the information from the bar code reading sensor 38 to selectively convey the film A or B to either of the first and second development tanks 2 and 4.

With respect to the replenishment of the processing solutions, the controller 40 further sets a replenishing mode on the basis of the information from the bar code reading sensor 38 to control the operations of the replenishing pumps 44 and 45 to thereby perform replenishment of the processing solutions. In this manner, the conveyance path and the replenishing mode are set on the basis of the kind of the film A or B, so that the film A or B is prevented from being treated with an unsuitable developer by mistake. Accordingly, reliability of processing is improved. Further, because replenishment of the processing solutions are not performed by mistake, the functions of the treating solutions can be maintained appropriately.

The replenishment rates of the processing solutions vary not only according to the kind of the developer but according to the quantity of processing, the photographing condition, etc. It is therefore preferable that the replenishment rate be determined on the basis of the quantity of supply detected by the conveyance quantity detection sensor 31 and the density of the frames detected by the density detection sensor 25. All information necessary for determination of the replenishment rates is stored in the memory 46, so that the controller 40 calculates the replenishment rates by using the arithmetic operation means 48 on the basis of information read from the sensors 38, 31 and 25 and information read from the memory 46.

Further, information concerning the timing of replenishment is stored in the memory 46, so that it is preferable that the controller 40 set the timing of replenishment by referring to the information stored in the memory 46. For example, in the case of a low-replenishment developer, the replenishment rate in one time is small so that the influence of errors caused by the pumps or the like is large. The errors accumulate as such replenishment is repeated. Therefore, a predetermined replenishment rate is collectively supplied at a point of time when the quantity of processing reaches a predetermined value to thereby make it possible to reduce error and perform accurate replenishment. The quantity of processing can be calculated as a processed area on the basis of the quantity of conveyance detected by the conveyance quantity detection sensor 31 and the width of the film A or B, so that replenishment is performed when the processed area reaches a predetermined value. For example, in the case where 20 ml of replenisher is supplied whenever one roll of film A or B is processed, 60 mol of replenisher is collectively actually supplied at a point of time when three rolls of film A or B are processed. If the replenishment rate at one time is too large, hunting in composition variations in the treating solution becomes large so that performance cannot be maintained in a predetermined range. Accordingly, the replenishment rate at one time is preferably not larger than 5% of the quantity of the tank solution in the treating tank. In the case where 60 ml of replenisher is supplied as one time as described above, the quantity of the tank solution in the treating tank is preferably not smaller than 1.2 l.

Although the aforementioned replenishment is performed on the basis of the replenishment rate and the timing of replenishment calculated on the basis of the quantity of processing in turn calculated on the basis of the quantity of conveyance, replenishment may be performed in the same manner as described above on the basis of the quantity of processing calculated on the basis of the number of frames detected by the density detection sensor 25. Alternatively, the density of each frame may be detected by the density detection sensor 25 so that replenishment can be performed whenever the accumulated value of one frame density thus detected reaches a predetermined value. In this case, the "predetermined value" means the accumulated density value of all frames in a predetermined quantity (number) of processed films. In the aforementioned case where 60 ml of replenisher is supplied at a point of time when three rolls of film A or B are processed, the average accumulated density value in the case where all frames in three rolls of film A or B are subjected to photographing is stored in the memory 46 in advance.

Figure 6:
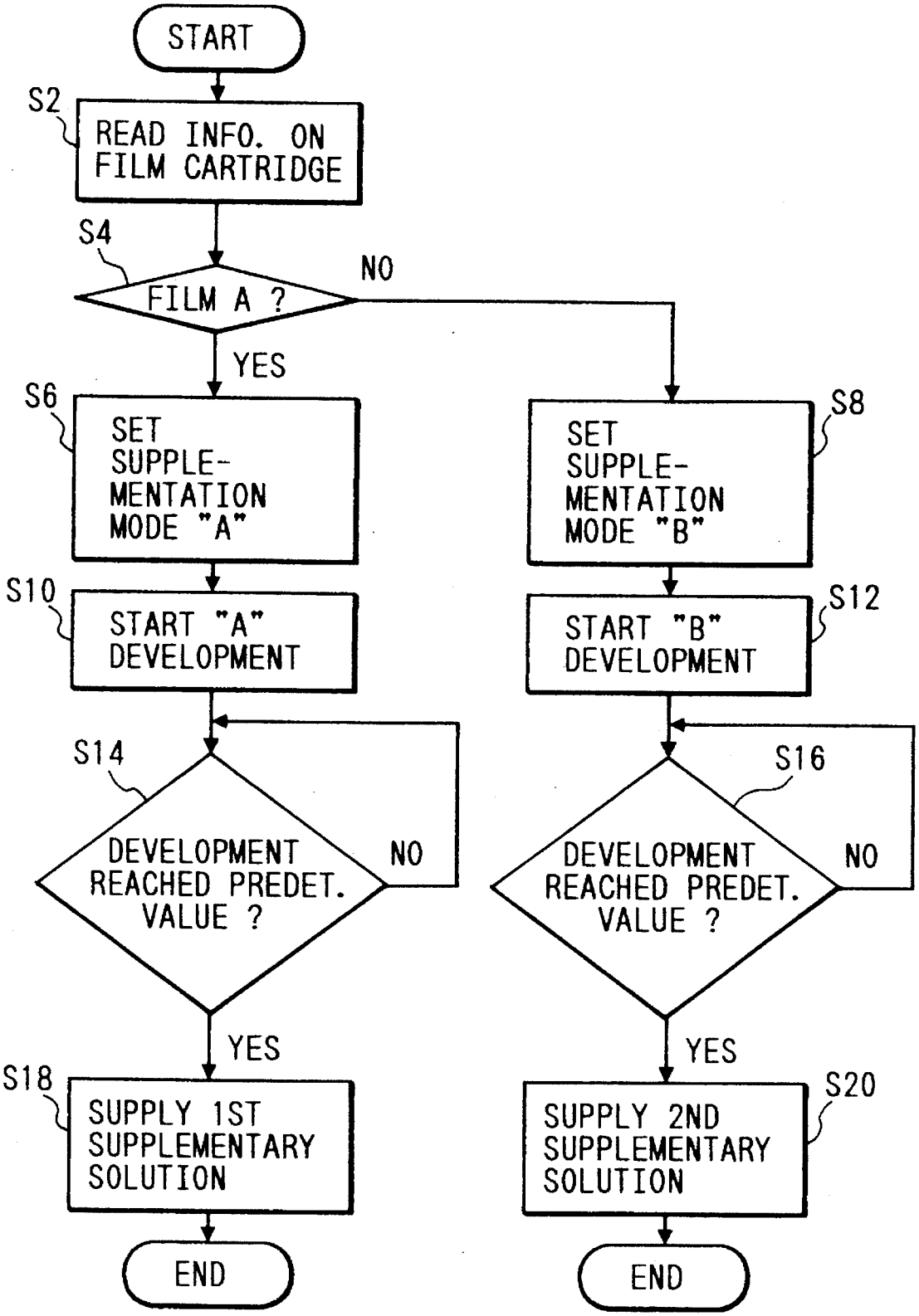
FIG. 6 is a flow chart of supplement control.

In the following, film processing control and replenishment control will be described with reference to FIG. 6.

When a roll of film A or B is charged in the charging portion, information on the cartridge 26 is read by the bar code reading sensor 38 (S2). The information thus read is supplied to the controller 40, and information concerning the film A or B is judged by the controller 40 (S4). The controller 40 operates the movable guide members 21 and 32 to set the conveyance path of the film A or B on the basis of this information, and then the controller 40 operates the conveyance rollers 30 and 24 to convey the film A or B. Information of a "recipe" for processing of the film A or B is carried on the cartridge 26, so that the film A or B is conveyed toward either of the developing tanks 2 and 4 in which a developer designated by the recipe carried on the cartridge is accommodated.

In the case where a recipe designating another solution than the developers accommodated in the two development tanks 2 and 4 is carried on the cartridge 26, the movable guide members 21 and 32 and the conveyance rollers 30 and 24 are not operated so that the film A or B is not conveyed. Further, the fact that the recipe for processing of the film A or B does not coincide with those in the developers in the apparatus is indicated on an operation panel or the like or an alarm is issued.

Further, the controller 40 sets the replenishment mode corresponding to the selected developer (S6, S8), so that the replenishing pumps 44 and 45 operate in the chosen replenishment mode to control the replenishment rate, the timing of replenishment, etc., appropriately.

After the replenishment mode corresponding to the film A or B is set appropriately, development corresponding to the film A or B is started (S10, S12). When the quantity of processing of the film A or B calculated with the progress of development reaches a predetermined value (S14, S16), the replenishment rate corresponding to the quantity of processing of the film A or B is read from the memory 46. The "quantity of processing" used herein means a quantity calculated as a function of factors such as the quantity of conveyance of film, the area of processed image, the density of processed image, or the like, which is used as a reference for estimating the quantity of the developing agent consumed by the development.

In any type film, replenishers are supplied substantially on the basis of the quantity of processing of film (S18, S20). The quantity of processing is detected by using at least one of the conveyance quantity detection sensor and the density detection sensor. When, for example, the conveyance quantity detection sensor is used, the processed area is calculated by the arithmetic operation unit 48 on the basis of the width of film and the quantity of conveyance detected by the sensor 31 on the basis of film conveyance speed, film conveyance time, etc. The processed area thus calculated is stored in the memory 46 on an accumulated basis. When the accumulated value of the processed area reaches a predetermined value, replenishment is performed. When, for example, the density detection sensor 25 is used, the density of each frame detected by the sensor 25 is stored in the memory 46 while being accumulated. When the accumulated density value reaches a predetermined value, replenishment is performed.

The density sensor 25 detects the optical density of the film A or B inclusive of the mask density of the film A or B. If the optical density inclusive of the mask density is accumulated, it is impossible to calculate the quantity of the developing agent consumed by the development accurately. Therefore, mask density values in accordance with the kind of the film A or B, compensation functions for subtracting the mask density from the detected density, and the like, are stored in the memory 46 in advance, so that values obtained by subtracting the mask .density from the detected density are accumulated at the time of calculation of the replenishment rate. Accordingly, density values produced by consumption of the developing agent can be accumulated accurately, so that the replenishment rate necessary for recovery of performance of the developer can be calculated accurately.

Further, the number of frames can be measured by the density detection sensor 25, so that the number of frames thus measured is stored in the memory while accumulated. The quantity of processing is judged from the accumulated value of the number of frames so that replenishment is performed when the accumulated value of the number of frames reaches a predetermined value. For measurement of the number of frames, another contact type sensor may be used.

Respective reference values for the accumulated value of the processed area, the accumulated value of the optical density and the accumulated value of the number of frames, which are references for execution of the replenishing operation, are set in accordance with the kind of the film A or B or calculated experimentally in advance. The reference values are stored as a look-up table (LUT) in the memory 46. In the case of film A to be subjected to the standard process, the quantities of tank solutions in the treating tanks are large so that adverse the influence caused by error in the stroke discharge volume of the replenishing pump 44 is small. On the contrary, in a low-replenishment treating solution and a speedy treating solution in which the quantities of tank solutions in the treating tanks are small, error in the stroke discharge volume of the replenishing pump 45 exerts a large influence on the performance of the treating solutions. It is therefore preferable that replenishment of a small quantity of treating solution in a tank be performed so that the replenishment per dose is increased as much as possible and so that the replenishing interval is increased as much as possible to a range such that adverse influences are estimated. In the aforementioned case where 20 ml of replenisher is supplied whenever one roll of film is processed, the interval is therefore increased so that 60 ml of replenisher is supplied whenever three rolls of film are processed.

Although the above-mentioned control is performed by the controller 40 on the basis of bar code 36 information read by the bar code reading sensor 38, information such as discrimination between the kinds films A and B, setting of a replenishment mode, setting of a development mode, etc. may be supplied to the controller 40 by manual operator input.

Having described replenishing control in accordance with the quantity of processing, vaporization replenishment will be described below.

In FIG. 5, the first liquid temperature sensor 60 detects the temperature $T_1$ of the developer in the first development tank 2, the second liquid temperature sensor 62 detects the temperature $T_2$ of the developer in the second development tank 4, the ambient temperature sensor 64 detects the ambient temperature $T_3$ of the processing apparatus, and the humidity sensor 66 detects the ambient humidity H. The controller 40 calculates the quantity of water vaporized and reduced in a predetermined time on the basis of each of the first and second developer temperatures $T_1$ and $T_2$, the actual running time of the apparatus, the temperature adjustment time, the stopped time, etc., and controls the replenishing pumps 44 and 45 to supply the calculated quantity of water. In this case, only water without main components and the like is generally supplied as the replenisher.

Examples of factors for calculating the replenishment rate to correct for vaporization include the respective temperatures $T_1$, $T_2$ and $T_3$ and the humidity H. The controller 40 may calculate the replenishment rate on the basis of the values of these temperatures per se or may calculate the replenishment rate on the basis of difference between liquid temperatures or the difference between liquid temperature and ambient temperature. Further, the controller 40 may calculate the replenishment rate on the basis of the respective accumulated values of the measured temperatures $T_1$, $T_2$ and $T_3$, or may perform correction of the calculated replenishment rate taking into consideration the humidity H or the like.

Further, other than calculating the replenishment rate on the basis of the actually measured values $T_1$, $T_2$, $T_3$ and H, the replenishment rate may be calculated on the basis of set temperatures at the time of planning and taking into consideration the shape of the treating apparatus (for example, area of gas-liquid interface, the degree of sealing around a tank, etc.), air discharging conditions, and so on, as occasion demands.

With respect to the configuration of the apparatus, it is possible for different kinds of developers to be accommodated in the development tanks 2 and 4 so that different types of films A and B are processed alternately. As to replenishment control, it is however preferable that the same process be carried out for a predetermined period. The reason is as follows. Although the main replenishment control is that replenishment be performed in accordance with the quantity of processing of the film A or B, there are other replenishments such as replenishment to compensate for air oxidation and replenishment for vaporization in the case of intermittent processing in which film processing is carried out at a low frequency. Accordingly, correction of these replenishment factors is complicated if different types of films A and B are processed in a short continuous time. It is therefore preferable that a replenishment mode based on the premise that processing must be continued for a predetermined time be carried on each of the films A and B.

Figure 7A:
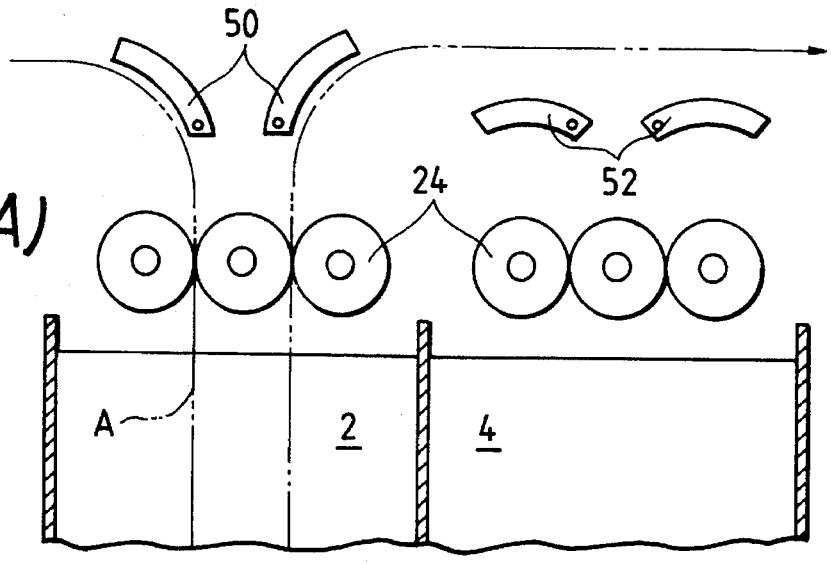
FIGS. 7(A) and 7(B) are enlarged views of a modified example of the light-sensitive material conveyance switching structure.
Figure 7B:
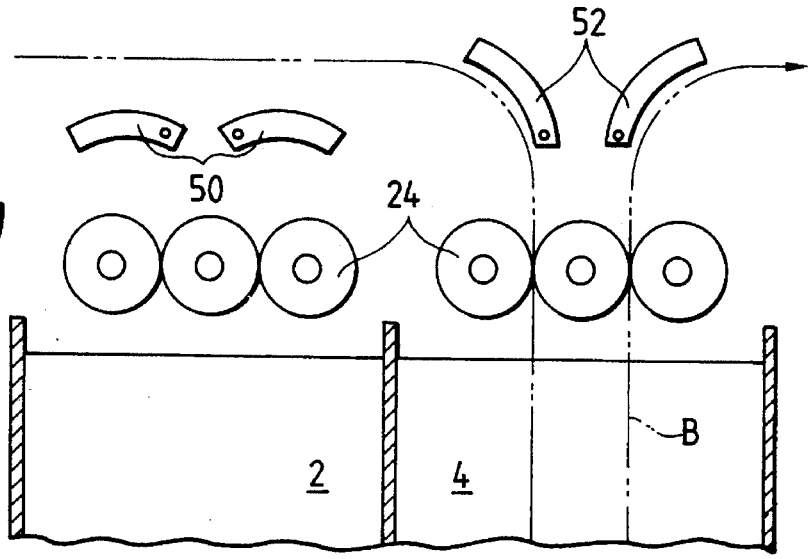

FIGS. 7(A) and 7(B) are sectional views of portions of a modified example of the conveyance path switching structure. In this structure, one film conveyance inlet is provided, and conveyance path switching guide pairs 50 and 52 are provided above the first and second development tanks 2 and 4, respectively. At the time of conveyance of the film A to the first development tank 2, as shown in FIG. 7(A), the first switching guide pair 50 above the first development tank 2 is in a position to guide the film A to the first development tank 2 and guide the film A toward the bleaching tank 6, whereas the switching guide pair 52 above the second development tank 4 is in a position in which the pair 52 retreats from the conveyance path of the film A coming out of the first development tank 2.

At the time of conveyance of the film B to the second development tank 4, as shown in FIG. 7(B), the switching guide pair 50 above the first development tank 2 is in a position in which the pair 50 retreats from the conveyance path leading the film to the second development tank 4, whereas the switching guide pair 52 above the second developing tank 4 is in a position to guide the film B to the second development tank 4 and guide the film B toward the bleaching tank 6.

Of course, the switching operations of the switching guide pairs 50 and 52 are controlled by the controller 40 on the basis of the aforementioned information stored as a bar code 36.

Alternatively, the conveyance roller pair 30 in the film charging portion 28 may be formed so as to be movable vertically to thereby form two introduction paths 20 and 22 in accordance with the height of the conveyance roller pair 30 so that one path can be selected from the two introduction paths by positioning the conveyance roller pair 30 at the height of either of the introduction paths.

Although preferred embodiments of the present invention have been described above, the light-sensitive material processed in the present invention is not specifically limited and, accordingly, the kind of the developer for processing the light-sensitive material is not limited to the above description.

EXAMPLE

Light-Sensitive Material:

A: SHG400 color negative film made by Fuji Photo Film Co., Ltd.
B: SHG1600 color negative film made by Fuji Photo Film Co., Ltd.

Color Developer:

| | Tank Solution (g) | Replenisher (g) |
|---|---|---|
| A: Color Developer-1: | | |
| diethylenetriamine-pentacetic acid | 2.0 | 2.0 |
| 1-hydroxyethylidene-1,1-diphosphonic acid | 3.3 | 3.3 |
| sodium sulfite | 3.9 | 5.1 |
| potassium carbonate | 37.5 | 39.0 |
| potassium bromide | 1.4 | 0.4 |
| potassium iodide | 1.3 mg | — |
| hydroxylamine sulfate | 2.4 | 3.3 |
| 2-methyl-4-[N-ethyl-N-(β-hydroxylethyl) amino] aniline sulfate | 4.5 | 6.0 |
| total amount of developer after addition of water | 1.0 l | 1.0 l |
| pH | 10.05 | 10.15 |
| B: Color Developer-2: | | |
| diethylenetriamine-pentacetic acid | 2.0 | 4.0 |
| 1-hydroxyethylidene-1,1-diphosphonic acid | 3.3 | 3.3 |
| sodium sulfite | 3.9 | 6.5 |
| potassium carbonate | 37.5 | 39.0 |
| potassium bromide | 7.0 | — |
| potassium iodide | 1.3 mg | — |
| hydroxylamine sulfate | 2.4 | 4.5 |
| 2-methyl-4-[N-ethyl-N-(β-hydroxylethyl) amino]aniline sulfate | 15.0 | 24.0 |
| total amount of developer after addition of water | 1.0 l | 1.0 l |
| pH | 10.05 | 10.25 |
| Bleaching Solution: | | |
| ferric-ammonium 1,3-diaminopropane tetraacetate monohydrate | 130 | 195 |
| ammonium bromide | 70 | 105 |
| aluminum nitrate | 14 | 21 |
| hydroxyacetic acid | 50 | 75 |
| aceticacid | 40 | 60 |
| total amount of solution after addition of water | 1.0 l | 1.0 l |
| pH (adjusted by aqueous ammonia) | 4.4 | 4.4 |

-continued

Bleach-Fixing Tank Solution:

A mixture of the above-mentioned bleaching tank solution and the following fixing tank solution in the proportion (volume) 15:85.

Fixing Solution:

| | | |
|---|---|---|
| ammonium sulfite | 19 | 57 |
| aqueous ammonium thiosulfate solution (700 g/l) | 280 ml | 840 ml |
| imidazole | 15 | 45 |
| ethylenediamine-tetraacetic acid | 15 | 45 |
| total amount of solution after addition of water | 1.0 l | 1.0 l |
| pH | 74 | 7.45 |

Stabilizing Solution:

| | Common to Tank Solution/Replenisher (g) |
|---|---|
| sodium p-toluenesulfinate | 0.03 |
| p-nonlyphenyl-polyglycidol (average polymerization degree: 7) | 0.2 |
| disodium ethylene-diaminetetraacetate | 0.05 |
| 1,2,4-triazole | 1.3 |
| 1,4-bis(1,2,4-triazole-1-ylmethyl) piperazine | 0.75 |
| total amount of solution after addition of water | 1.0 l |
| pH | 8.5 |

| Process | Processing Time | Processing Temperature | Amount of Replenisher (ml/m²) | Tank Volume |
|---|---|---|---|---|
| Color development A | 3 min, 5 sec | 38° C. | 600 | 15 l |
| Color development B | 1 min | 48° C. | 90 | 5 l |
| Bleaching | 50 sec | 38° C. | 140 | 5 l |
| Bleaching-fixing | 50 sec | 38° C. | — | 5 l |
| Fixing | 50 sec | 38° C. | 210 | 5 l |
| Stabilization (1) | 20 sec | 38° C. | — | 3 l |
| Stabilization (2) | 20 sec | 38° C. | — | 3 l |
| Stabilization (3) | 20 sec | 38° C. | 420 | 3 l |
| Drying | 1 min, 30 sec | 60° C. | 420 | 3 l |

In the stabilization process, a counterflow cascade from (3) to (1) was used. There was no washing process. Further, the entire amount of an overflow solution from the stabilization (1) was introduced into the fixing tank.

Two types of 135-size 24-exposure films A and B were processed by the processing apparatus shown in FIG. 1 in such a manner that every 100 rolls of film were subjected to the low-temperature (standard) process and the high-temperature low-replenishment (speedy) process.

DETECTION OF THE QUANTITY OF PROCESSING AND REPLENISHMENT

The number of exposure images was detected using the density sensor 25.

For color development 1, replenishment in an amount of 105 ml was performed whenever 120 frames were processed. For color development 2, replenishment of 50 ml was performed whenever 400 frames were processed.

As a result of the above-mentioned replenishment, constant high performance could be maintained for each color development.

According to the present invention, a plurality of different light-sensitive materials are selectively conveyed to a plurality of development tanks and processed in the plurality of development tanks, so that development of a plurality of light-sensitive materials different in function can be carried out by one apparatus without any increase of the size of the apparatus. Furthermore, the replenishment rate appropriate to respective developers are calculated and supplied so that good developed images were obtained which did not change over the time development and for different kinds of the light-sensitive material.

What is claimed is:

1. An apparatus for processing photosensitive material comprising:

supply means for supplying said photosensitive material;

a plurality of development tanks for developing latent images on said photosensitive material, in which a plurality of different color developers are accommodated, respectively;

control means, including determination means for determining which one of said development tanks corresponds to characteristics of processing desired for said photosensitive material thus supplied; and conveying means responsive to the control means for conveying said photosensitive material from the supply means to said one development tank based on a determination by the determination means.

2. The apparatus according to claim 1, further comprising a means for detecting said characteristics of the processing desired for said photosensitive material.

3. The apparatus according to claim 1, wherein said control means calculates a replenishment rate for each of the developers of said plurality of development tanks, individually.

4. The apparatus according to claim 3, further comprising a conveyance quantity detecting sensor for detecting a quantity of said photo sensitive material thus processed, wherein said control means calculates said replenishment rate on the basis of the accumulated value of said processed quantity of said photo sensitive material.

5. The apparatus according to claim 3, further comprising a density detection sensor for detecting the density of said photo sensitive material thus processed.

6. The apparatus according to claim 5, wherein said control means calculates said replenishment rate on the basis of the accumulated value of said density of said photo sensitive material thus processed.

7. The apparatus according to claim 5, wherein said control means calculates said replenishment rate on the basis of a number of exposed images on said photo sensitive material thus processed, which corresponds to said total density of said photo sensitive material.

8. The apparatus according to claim 3, wherein said control means supplies said developer in batches after processing of a predetermined quantity of photo sensitive materials.

9. The apparatus according to claim 8, wherein said quantities of said developer in any one dose thereof in any of said tanks is not larger than 7% of a total quantity of said developer in the tank.

10. The apparatus according to claim 1, wherein said control means calculates a replenishment rate for supplemental water of said plurality of development tanks.

11. The apparatus according to claim 10, wherein said replenishment rate is determined on the basis of at least one of sensing (a) an ambient temperature and humidity around said development tanks and (b) temperature of said developer.

12. The apparatus according to claim 1, wherein said determination means includes a sensor for detecting indicia on one of said photosensitive material and a container containing said photosensitive material, said indicia identifying said characteristics of the processing desired for said photosensitive material.

13. The apparatus according to claim 12, wherein said indicia comprise one of a bar code, magnetically recorded information, a CAS code, electronically recorded information, and a physical shape.

14. A method of processing photosensitive material comprising the steps of:

supplying said photosensitive material;

determining which one of a plurality of development tanks corresponds to characteristics of processing desired for said photosensitive material thus supplied, a plurality of different color developers being accommodated in said development tanks, respectively;

conveying said photosensitive material to said one development tank; and developing latent images on said photosensitive material in said one development tank.

15. The method according to claim 14, wherein said determining step calculates a replenishment rate for each of the developers of said plurality of development tanks, individually.

16. The method according to claim 15, wherein said determining step calculates said replenishment rate on the basis of the accumulated value of the quantity of said photo sensitive material thus processed.

17. The method according to claim 15 wherein said determining step calculates said replenishment rate on the basis of the accumulated value of the density of said photo sensitive material thus processed.

18. The method according to claim 17, wherein said determining step calculates said replenishment rate on the basis of a number of exposed images on said photo sensitive material thus processed which corresponds to said accumulated density of said photo sensitive material.

19. The apparatus according to claim 14, wherein said determining step comprises a step of detecting indicia on one of said photosensitive material and a container containing said photosensitive material, said indicia identifying said characteristics of the processing desired for said photosensitive material.

20. The apparatus according to claim 19, wherein said indicia comprise one of a bar code, magnetically recorded information, a CAS code, electronically recorded information, and a physical shape.

* * * * *